US006073696A

United States Patent [19]

Ellis

[11] Patent Number: 6,073,696

[45] Date of Patent: Jun. 13, 2000

[54] METHOD AND ASSEMBLY FOR TREATING AND PRODUCING A WELBORE USING DUAL TUBING STRINGS

[75] Inventor: Harvey Andrew Ellis, Katy, Tex.

[73] Assignee: Vastar Resources, Inc., Houston, Tex.

[21] Appl. No.: 08/962,996

[22] Filed: Nov. 2, 1997

[51] Int. Cl.[7] ..... E21B 21/00; E21B 37/07

[52] U.S. Cl. ..... 166/312; 166/50; 166/222; 166/242.3

[58] Field of Search ..... 166/312, 50, 313, 166/157, 205, 222, 242.3, 303

[56] References Cited

U.S. PATENT DOCUMENTS

| | | | |
|---|---|---|---|
| 4,116,275 | 9/1978 | Butler et al. | 166/303 |
| 4,565,245 | 1/1986 | Mims et al. | 166/50 |
| 4,945,995 | 8/1990 | Tholance et al. | 166/375 |
| 5,289,881 | 3/1994 | Schuh . | |
| 5,297,627 | 3/1994 | Sanchez et al. | 166/272 |
| 5,626,193 | 5/1997 | Nzekwu et al. | 166/303 |
| 5,865,249 | 2/1999 | Gipson et al. | 166/312 |
| 5,931,230 | 8/1999 | Lesage et al. | 166/303 |

OTHER PUBLICATIONS

"Steam Circulation in Horizonal Wellbores"; D.A. Best et al; SPE/DOE 20203; presented at Tulsa, OK. Apr. 22–25, 1990.

"Horizontal Well Sand Cleanouts"; B.D. Heinrichs et al; SPE 30269; Calgary, Alberta, Canada; Jun., 1996.

Co–pending U.S. Patent Application; Serial No. 08/838,901; filed Apr. 11, 1997.

*Primary Examiner*—David Bagnell

*Assistant Examiner*—Chong S. Cho

*Attorney, Agent, or Firm*—Drude Faulconer

[57] ABSTRACT

A method and assembly for treating a portion (e.g. horizontal) of a wellbore for removing solids and for producing fluids therefrom. The assembly is comprised of dual flowpaths (e.g. tubing strings) extend from the surface into the portion of the wellbore to be treated and produced. A liner is connected on the lower end of the first flowpath while the second flowpath terminates within the upper end of the wellbore portion. A treating fluid is flowed down the first flowpath and through the liner into the wellbore to wash and entrain solids therein. The treating fluid and solids are then circulated back to the surface through the second flowpath. After treatment, the second flowpath is closed and fluids are produced through the liner and to the surface through the first flowpath.

13 Claims, 4 Drawing Sheets

METHOD AND ASSEMBLY FOR TREATING AND PRODUCING A WELBORE USING DUAL TUBING STRINGS

DESCRIPTION

1. Technical Field

The present invention relates to a method and apparatus for treating and producing a wellbore using dual tubing strings and in one of its aspects relates to a method and downhole assembly for treating (e.g. cleaning) and producing a substantially horizontal portion of a wellbore by using parallel strings of tubing which extend from the surface into the horizontal portion of the wellbore.

2. Background Art

In producing hydrocarbons or the like from certain subterranean formations, it is now common to drill a wellbore having a highly-inclined or horizontal portion which extends outward into the production formation. As will be understood in this art, an "inclined, high-angled" well is one wherein at least that portion of the wellbore which passes into or through the production formation is drilled at a high-angle with the respect to the vertical while a "horizontal" well is one which is normally drilled substantially vertical from the surface and then diverted approximately 90° as it approaches the production formation so that the lower portion of the wellbore will extend substantially horizontal within the formation. As used herein, the term "horizontal" when referring to a wellbore is intended to refer to both of these types of wells.

During the production of hydrocarbons, particulate material or solids (e.g. sand) are routinely produced along with fluids from the formation. While sand production is a problem, regardless of the type of wellbore involved, it is usually even more serious in horizontal wellbores. To alleviate or hopefully eliminate the problems caused by sand production, a well screen is routinely attached to the lower end of the production tubing and is installed within the horizontal, open-hole portion of the wellbore. The screen allows the production fluids to flow therethrough and up to the surface through the production tubing while effectively blocking any substantial flow of solids into the screen.

However, in such completions, it is usually necessary to "clean" up the well before commencing production in order to eliminate or substantially reduce the "fines" which are normally present in the well and which are likely to plug the screen if the well goes untreated. For example, in drilling horizontal wellbores, special "drill-in fluids" are routinely used to form a thin, tough "filter cake" onto the wall of the open-hole wellbore as the well is being drilled.

As will be understood by those skilled in the art, while the formation of filter cake is vital during most drilling operations (e.g. it prevents the loss of drilling fluid into the more permeable formations along the wellbore, prevents caving of the wellbore, etc.), it can cause major problems when the well is put on production, e.g. this cake routinely breaks up and produces particles or "fines" which can plug the screen. Accordingly, it is highly desirable, if not absolutely necessary, to substantially remove this filter cake from the wall of the wellbore before producing the well fluids through the screen.

Presently, filter cake is typically removed by using standard, "gravel pack" tools (i.e. a screen suspended from a single tubing string) through which a treating fluid is pumped into the horizontal, open-hole portion of the wellbore. The fluid contacts, breaks apart, and dissolves the filter cake from the wall of the horizontal wellbore and carries it along with other drill solids back to the surface through the well annulus. Unfortunately, this circulation scheme does not always provide adequate cleaning of the wellbore whereupon the screen becomes plugged after only a short production cycle.

Further, even if the original cleaning operation is relatively successful, as the horizontal well is produced, formation "fines" (i.e. shale, clay and/or other particles) are likely to migrate into the wellbore along with the produced fluids and will ultimately plug the screen. If not properly treated, a plugged screen can result in the premature abandonment of a well before all of the recoverable hydrocarbons have been produced from a formation. Accordingly, it is important to have the ability to clean a plugged screen during the life of a well so that production can be resume at an acceptable rate.

SUMMARY OF THE INVENTION

The present invention provides a method and downhole assembly for treating a portion, e.g. a substantially horizontal portion, of a wellbore for removing solids and for producing fluids therefrom. The downhole assembly is basically comprised of dual, parallel flowpaths which extend from the surface into the portion of the wellbore to be treated and produced. The first of the dual flowpaths has a liner (e.g. well screen) connected to its lower end while the second of the dual flowpaths terminates within the upper end of said wellbore portion.

After the downhole assembly has been installed a treating fluid is flowed down the first flowpath and through the liner into the wellbore to wash the filter cake from the wall of the wellbore and to entrain solids therein. The treating fluid carry the solids back to the surface through the second flowpath. If desired, production fluids may be permitted flow into the wellbore to wash at least some of the initial solids to the surface through the second flowpath before any treating fluid is circulated through the wellbore. After substantially all of the recoverable solids have been circulated to the surface, the second flowpath is closed and fluids are then produced through the liner and up to the surface through the first or production flowpath.

More specifically, the downhole assembly of the present invention is comprised of a liner assembly which, in turn, is comprised of a liner section which has openings therein to allow flow of fluid into the liner while effectively blocking any substantial flow of solids therethrough. A first string of tubing (i.e. production tubing) extends through the wellbore and is fluidly connected at its lower end to the liner section. A second string of tubing (i.e. treatment/cleanup tubing) extends through the wellbore substantially parallel to said first string from the surface to a point substantially adjacent the top of the portion of the wellbore which is to be treated and produced.

In one embodiment, the liner assembly includes a sub section connected to the top of said liner section and has at least one port therein to allow flow into and out of said sub section. First packing means, e.g. dual packer, is provided within said sub section for blocking flow through the sub section around both said first and said second tubing strings. A second packing means is provided between the sub section and the wellbore to block flow around the sub section.

Further, in this embodiment, the first string of tubing extends through the liner assembly and is fluidly connected to a one-way valve which, in turn, is mounted in the lower end of the liner section. This valve allows flow out of but prevents flow into the first tubing string. Valve means, e.g.

sliding-sleeve valves, are spaced along a section of the first tubing string which lies within the liner section for allowing flow between the first tubing string and the liner when in an open positions and for preventing flow between the first tubing string and the liner when in a closed position.

In operation, a treating fluid is flowed down the first string of tubing out into the wellbore through the liner to thereby contact and entrain solids and the like within the wellbore. The treating fluid and entrained solids are then circulated back to the surface through the second string of tubing. After an adequate treatment period, flow of the treatment fluid is ceased and the second flowpath is closed. Formation fluids are then produced from the wellbore into the liner and to the surface through the first string of tubing.

The dual string completion of the present invention provides the same conventional, desired production flowpath through the liner (e.g. well screen) and up the first string of tubing (e.g. production tubing) as that provided in previous liner completions of this basic type (e.g. gravelpack completions) while providing several advantages not found in such completions. For example, the present invention provides (a) an alternate flowpath (i.e. second or treatment/cleanup string of tubing) for contaminated well fluids (i.e. clean up of filter cake, solids, etc.) without requiring such fluids to pass through the liner thereby alleviating potential plugging and damage to the liner; (b) the ability to achieve reverse flow through the liner (e.g. back flush from the production tubing through the liner and up through the treatment/cleanup string); and (c) an improved technique for placing treating fluids outside the liner at any stage of the production life of the well.

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
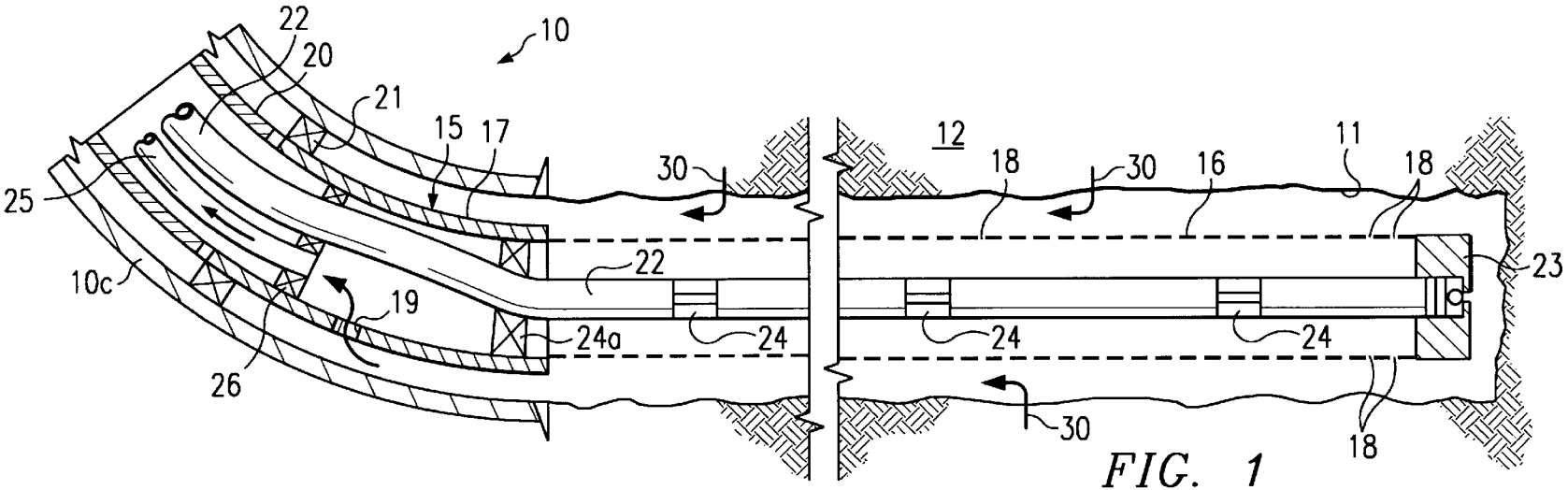
FIG. 1 is an elevational view, partly in section, of the downhole assembly of the present invention in an operable position within a horizontal portion of a wellbore illustrating an initial step of the treatment method of the present invention.
Figure 2:
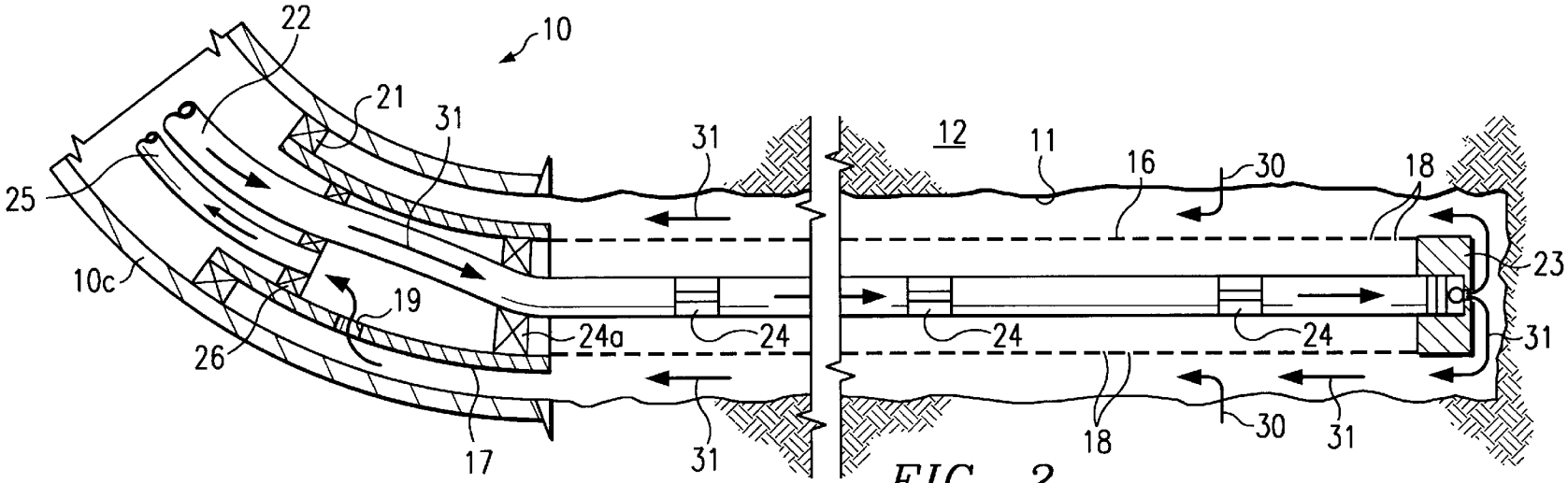
FIG. 2 is an elevational view, partly in section, of the downhole assembly of FIG. 1 illustrating a further step of the present invention.
Figure 3:
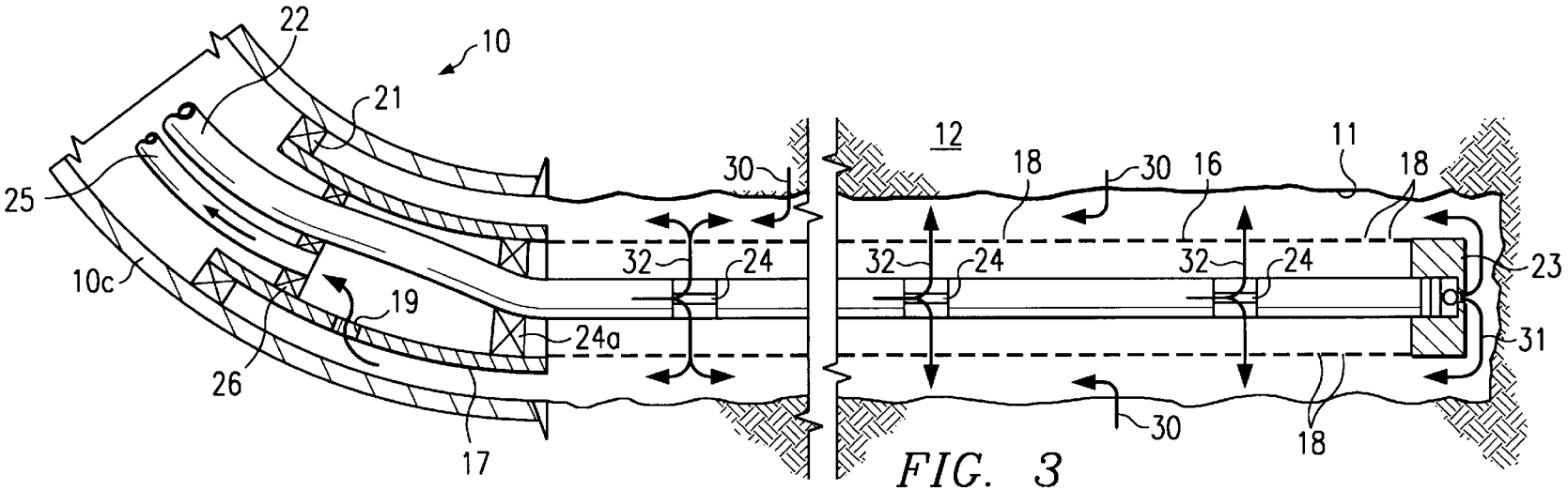
FIG. 3 is an elevational view, partly in section, of the downhole assembly of FIG. 1 when carrying out an alternate treatment step of the present invention.
Figure 4:
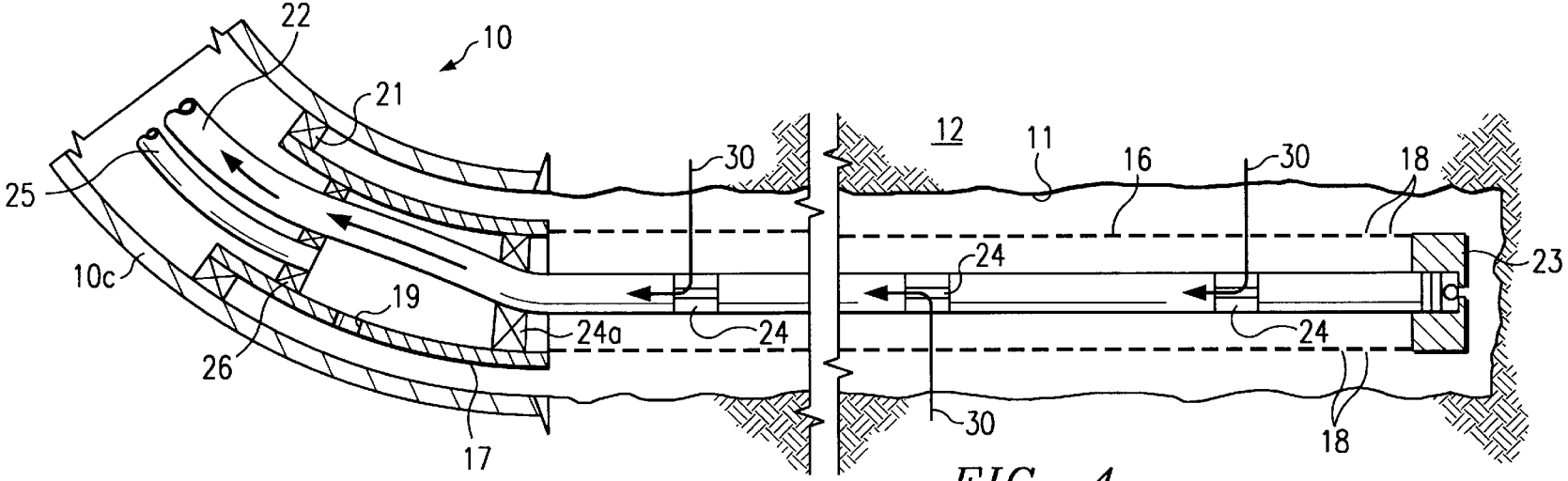
FIG. 4 is an elevational view, partly in section, of the downhole assembly of FIG. 3 when in a normal production mode in accordance with the present invention.
Figure 5:
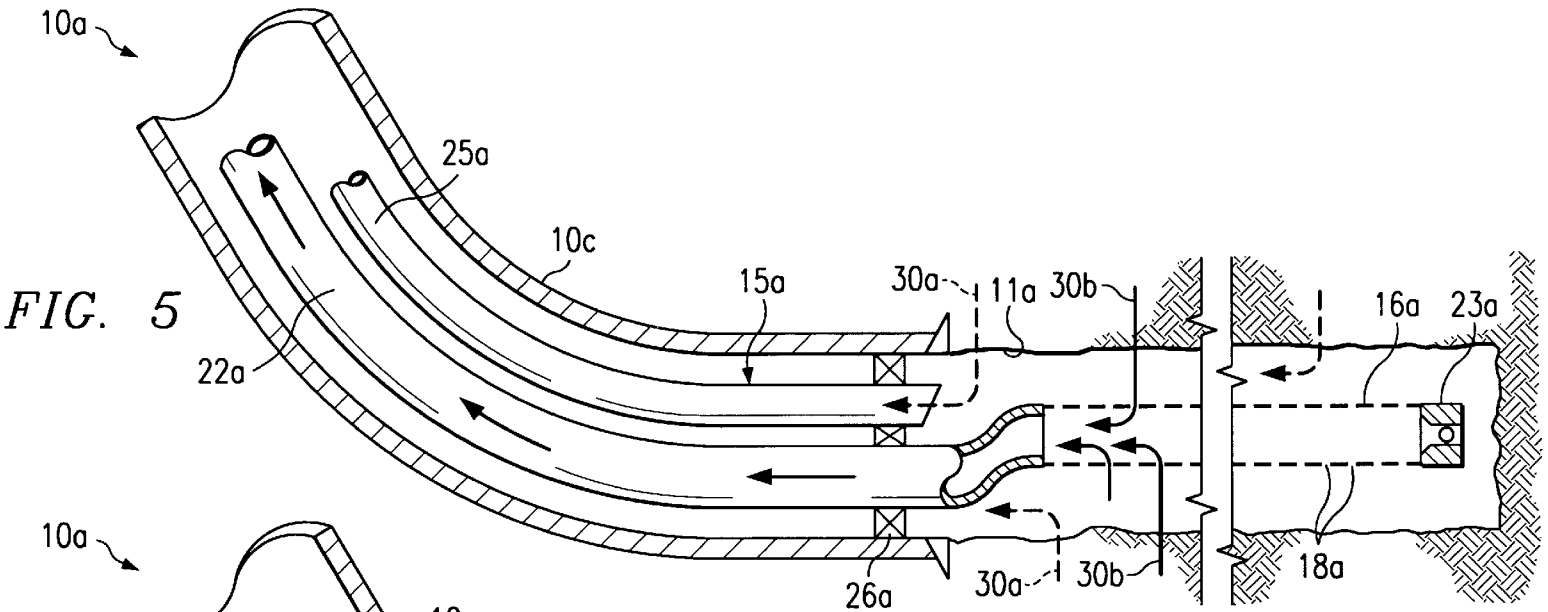
FIG. 5 is an elevational view, partly in section, of a another embodiment of the downhole assembly of the present invention in an operable position within a horizontal portion of a wellbore illustrating an initial step of the treatment method of the present invention.
Figure 6:
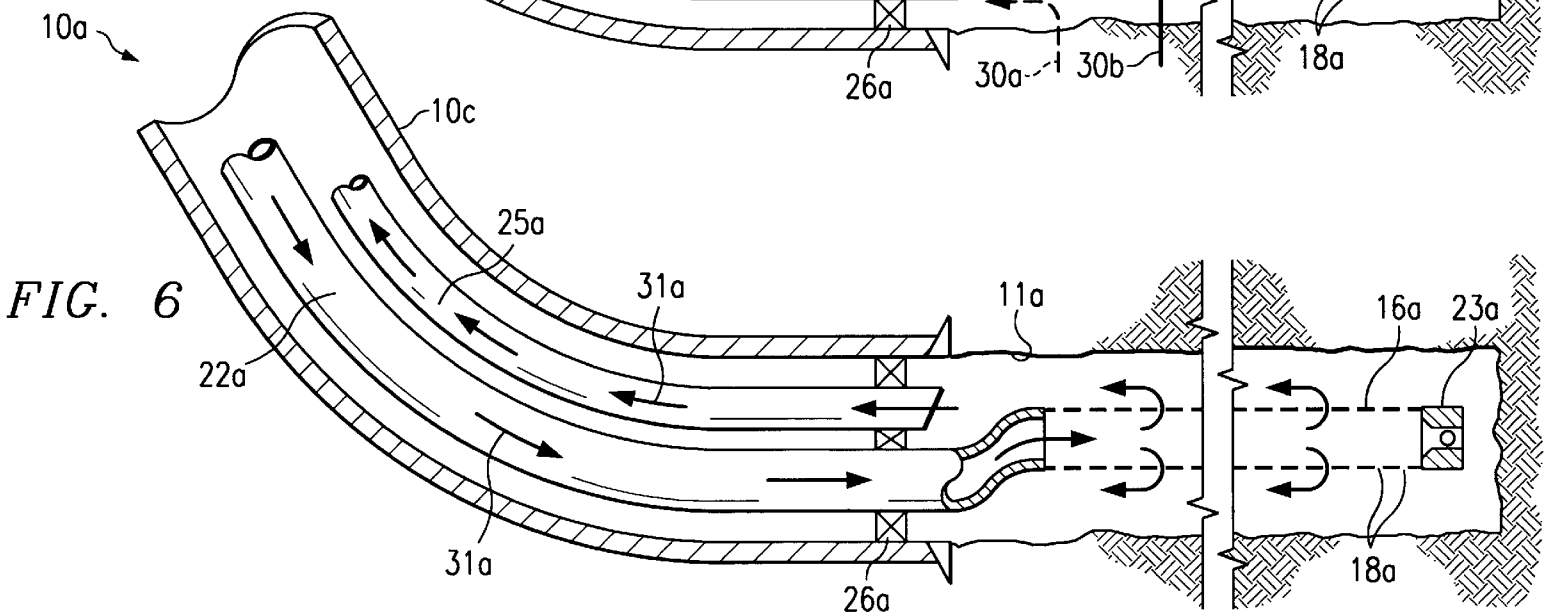
FIG. 6 is an elevational view, partly in section, of the downhole assembly of FIG. 5 illustrating a further clean-up step of the present invention.

Referring more particularly to the drawings, FIG. 1 illustrates the lower, "horizontal" portion 11 of a wellbore 10 which has been drilled from the surface (not shown) into a subterranean, producing formation 12. As will be understood in the art, wellbore 10 will typically have a substantially vertical portion (not shown) which is drilled downward from the surface to a point where the wellbore approaches formation producing 12. Using well known drilling techniques, the wellbore is then diverted through approximately 90° and drilling is continued to provide the wellbore with a substantially horizontal portion 11 which extends into formation 12.

While well 10 will be described primarily as one having a wellbore comprised of a vertical cased portion 10*c* and a contiguous open-hole, horizontal portion, "horizontal well", as used herein, is intended to include all wells which have at least a portion of its wellbore highly-inclined from the vertical and is intended to include inclined, high-angle wells as well as wells which have at least a portion of the wellbore extending substantially horizontal into the producing formation.

Further, while preferably used in a horizontal well, it should be understood that the present invention can also be used in conventional, substantially vertical wellbore as well. Accordingly, the terms "upper and lower", "top and bottom", "first and second", etc., if and when used herein, are intended to be used in their relative sense and are meant to refer to a relative position within a particular wellbore: be that wellbore be vertical, inclined, or horizontal. For example, in a horizontal wellbore, "upper" or "top" means a position within the wellbore which is at a shorter distance from the wellhead than is a "lower" or "bottom" position within the same wellbore.

Once the drilling of well 10 has been completed, a downhole assembly 15 is installed within wellbore 10. As illustrated in FIGS. 1–4, downhole assembly 15 is comprised of liner or screen section 16 and a sub section 17. Liner section 16 is typically comprised of a "fluid-permeable liner", which, for the sake of clarity, is shown in dotted lines in the figures to more clearly illustrate the plurality of openings 18 which lie along its length. The term "liner" or "screen", as used herein, is meant to be generic and to include any and all types of devices which allow flow therethrough but effectively block the flow of solids (e.g. screens, slotted pipes, screened pipes, perforated liners, pre-packed screens and/or liners, combinations of same, etc.) and which are used or could be used in well completions of this general type. As will be recognized by those skilled in the art, there are a relatively large number and variety of such "liners" which are presently commercially available.

Liner section 16 may be of a continuous length, as shown, or it may be comprised of a plurality of permeable segments (e.g. screen sections) connected together by subs or "blanks" (not shown). Sub section 17 is connected to the upper end of liner section 16 and has one or more openings or ports 19 therein for a purpose to be described below. Section 17 is adapted to be releasably connected to and lowered by a workstring 20 (FIG. 1) and carries a packer 21 which, when set, blocks flow through the well annulus between the sub section 17 and wellbore 10, 11. The use of such workstring to install liners and to set packers are well known in the art.

A first string of tubing 22 extends from the surface (not shown), through sub section 17, and all the way through liner 16. The lower end of tubing 22 is connected to one-way valve 23 or the like (e.g. float valve) which, in turn, is mounted in and closes the lower end of liner 16. As will be understood in the art, valve 23 allows fluid to flow out of tubing 22 and into wellbore 11 but blocks flow from the wellbore back into tubing 22. Seal means, e.g. packer 24*a*, blocks flow through the annulus formed between tubing string 22 and the interior of sub section 17.

Valve means 24 are incorporated into and are spaced along that section of tubing 22 which lies within liner section 16. As will be understood in the art, valves 24 may be of any type which can be remotely operated from the surface, e.g. commercially-available "sliding sleeve" valves which can be remotely opened and closed from the surface either hydraulically or by routine wire-line operations or by coiled tubing. When valves 24 are in an open position, flow is permitted therethrough in both directions, i.e. into and/or out of tubing string 22, and when in a closed position, flow is blocked in both directions.

A second string of tubing 25 runs substantially parallel to first string 22 and extends from the surface to a point within sub section 17. A first packing means 26 blocks flow through the annulus formed between the interior of sub section 17 and each of the tubing strings 22, 25. Packing means 26 may be comprised of a dual packer of the type commercially available for dually completing a well or it may be what is known in the art as a "parallel flow tube assembly".

In installing downhole assembly 15, the liner assembly and related tubing strings may be made-up at the surface and lowered as a unit on workstring 20 (FIG. 1 only). If lowered as a unit, the workstring 20 and both of the tubing strings 22, 25 will be made-up at the surface as liner assembly is being lowered, using conventional techniques for making-up well strings (i.e. adding joints of pipe as the unit is lowered). Once assembly 15 is in its operable position and packer 21 is set, workstring 20 is released and is retrieved to the surface, leaving liner section 16 within the horizontal portion 11 of the wellbore and adjacent producing formation 12.

It should be recognized that other installation techniques can be used in installing the downhole assembly of the present invention. For example, only the workstring 20 and the first string of tubing 22 is made-up during the lowering and positioning of the liner assembly. The second string 25 is then individually made-up and "stabbed-into" packing means 26. Another installation technique might involve using only workstring 20 to lower and position the liner within the wellbore. The entire second string 25 and the upper section of first string 22 are individually made-up and stabbed-into their respective openings in dual packing means 26. Also, it should be understood that after downhole assembly 15 is in place, gravel (not shown) can be placed in the annulus surrounding liner section 16 using conventional techiques to thereby form a typical gravel-pack completion if needed for sand control without departing from the present invention.

In accordance with the invention, it is preferred that all of the valves 24 in string 22 be initially closed so that any fluids flowing from formation 12 (arrows 30 in FIG. 1) can only flow through opening(s) 19 in sub section 17 and up to the surface through second tubing string 25. This flow of formation fluids will "wash" or clean-out much of any solids and fines which may be initially present in the wellbore or which are produced as the fluids flow into the wellbore. The fluids will entrain such solids and will carry them out of the wellbore.

After any initial free-flow period, a typical treating fluid, e.g. water, brine, acid or caustic solutions, surfactants, etc., (arrows 31 in FIG. 2) is pumped down the first string of tubing 22 and out one-way valve 23 at the end of liner 16 into wellbore 11 where the fluid contacts, breaks-up, and/or dissolves the filter cake which is typically present on the wall of the wellbore at the conclusion of the drilling operation. The treating fluid, along with the dissolved filter cake and any other entrained solids, flow through opening(s) 19 in sub section 17 and are circulated back to the surface through second tubing string 25. The flow of treating fluid is preferably continued until substantially all of the filter cake is removed and washed to the surface or until substantially no solids are being returned with the fluid, e.g. this can be determined by analyzing the returns.

The well is then put on production by opening sliding valves 24 and closing off flow through second tubing string 25. Produced fluids (arrows 30 in FIG. 4) will now flow through openings 18 in liner section 16, through the open valves 24, and up to the surface through first or production tubing string 22. As recognized in the art, the openings 18 in liner 16 are sized to allow flow of fluids therethrough while blocking any substantial flow of solids therethrough.

If during the initial clean-out of wellbore 11 or at any time during the production of the well, fines and/or other solids plug or severely block flow through the openings 18 in liner 16, productuon is ceased and a treating fluid such as any of those named above (arrows 32 in FIG. 3) is pumped down first or production tubing 22 and out through open valves 24. Since these valves are spaced along tubing 22, the treating fluid can exit directly onto the inside of liner 16 at several different points along its length thereby improving the washing action of the treating fluid. As the treating fluid flows through the openings 18 in liner 16, it washes the plugging material back from openings 18 into wellbore 11 and carries the material through opening(s) 19 in sub section 17 and up to the surface through now-open, second tubing string 25. Once liner 16 has been adequately cleaned, the flow of treating fluid 32 is ceased and second string 25 is again closed so that the well can be returned to production (see FIG. 4).

FIGS. 5–8 illustrate another embodiment of the downhole assembly of the present invention. Downhole assembly 15*a* is comprised of liner or screen section 16*a* similar to that described above except it does not include a sub section. Liner section 16*a* is fluidly connected to the lower end of a first or production string of tubing 22*a*. A second string of tubing 25*a* is positioned within well 10*a* substantially parallel to string 22*a* and extends from the surface to a point approximately adjacent the upper end of liner section 16*a*. Packing means (e.g. dual packer 26*a*) seals the well annulus around both strings of tubing to block any substantial flow therethrough, as will be understood in the art. Downhole assembly 15*a* and both strings of tubing can be made-up and lowered as a unit. Alternately, assembly 15*a* can be lowered only on production string 22*a* with second string 25*a* being individually made-up and then stabbed-into packing means 26*a* after assembly 15*a* is in its operable position within the wellbore.

In operation, once assembly 15*a* is in position, the initial flow from the formation (dotted arrows 30*a* in FIG. 5) will pick up and carry solids from wellbore 11*a* to the surface through open second tubing 25*a*. Preferably, production tubing 22*a* is closed during this initial clean-up period although only fluid (no solids) can flow through liner 16*a* in any event. After this initial free-flow, clean-out period, a treating fluid (arrows 31*a* in FIG. 6) is then pumped down production tubing string 22*a*. The fluid can flow out the bottom of liner 16*a* through valve 23*a* and at the same time flow out through the openings 18*a* along liner 16*a*.

The fluid contacts, breaks-up, and/or dissolves the filter cake if present on the wall of wellbore 11*a*. The dissolved filter cake along with other solids are carried by the treating fluid back to the surface through now open second tubing string 25*a*. The flow of treating fluid is then ceased and the well is put on production by closing second tubing string 22*a* and allowing the production fluids to flow through liner 16 and up to the surface through production string 22*a*.

Figure 7:
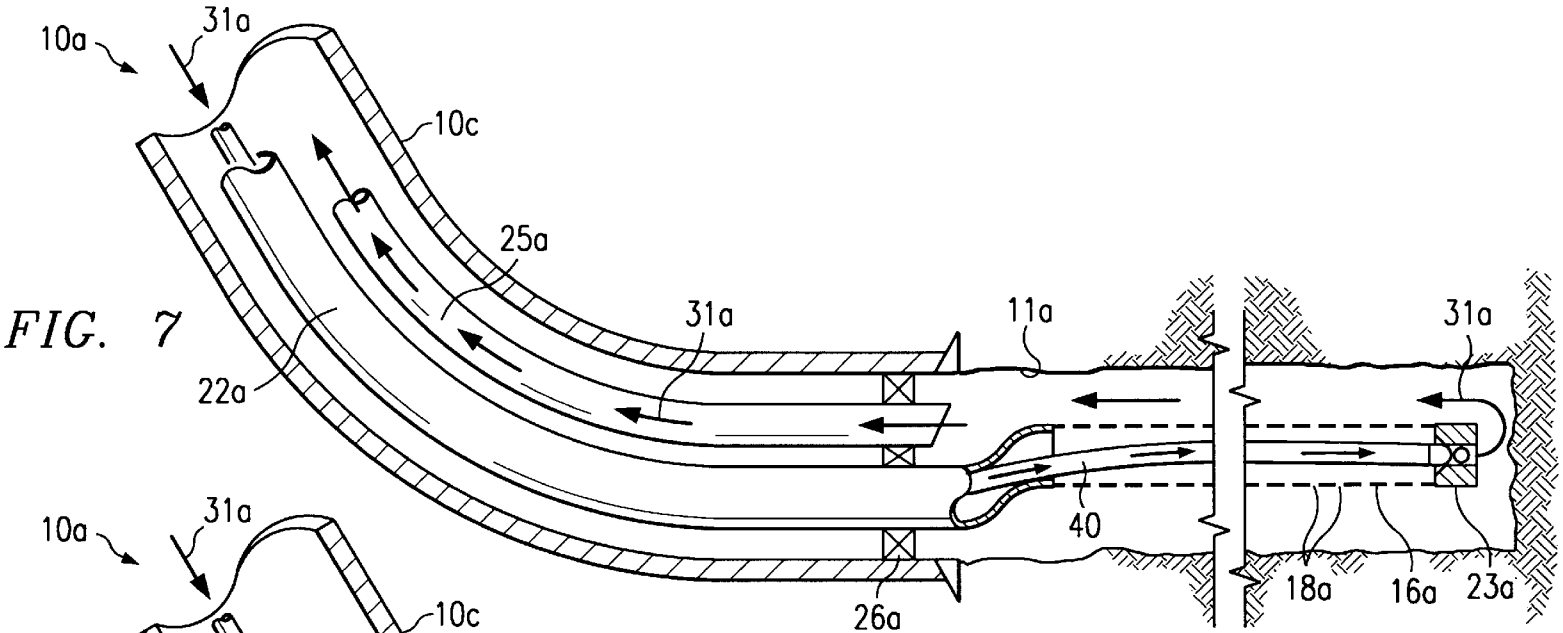
FIG. 7 is an elevational view, partly in section, of the downhole assembly of FIG. 5 illustrating an alternate clean-up step of the present invention.
Figure 8:
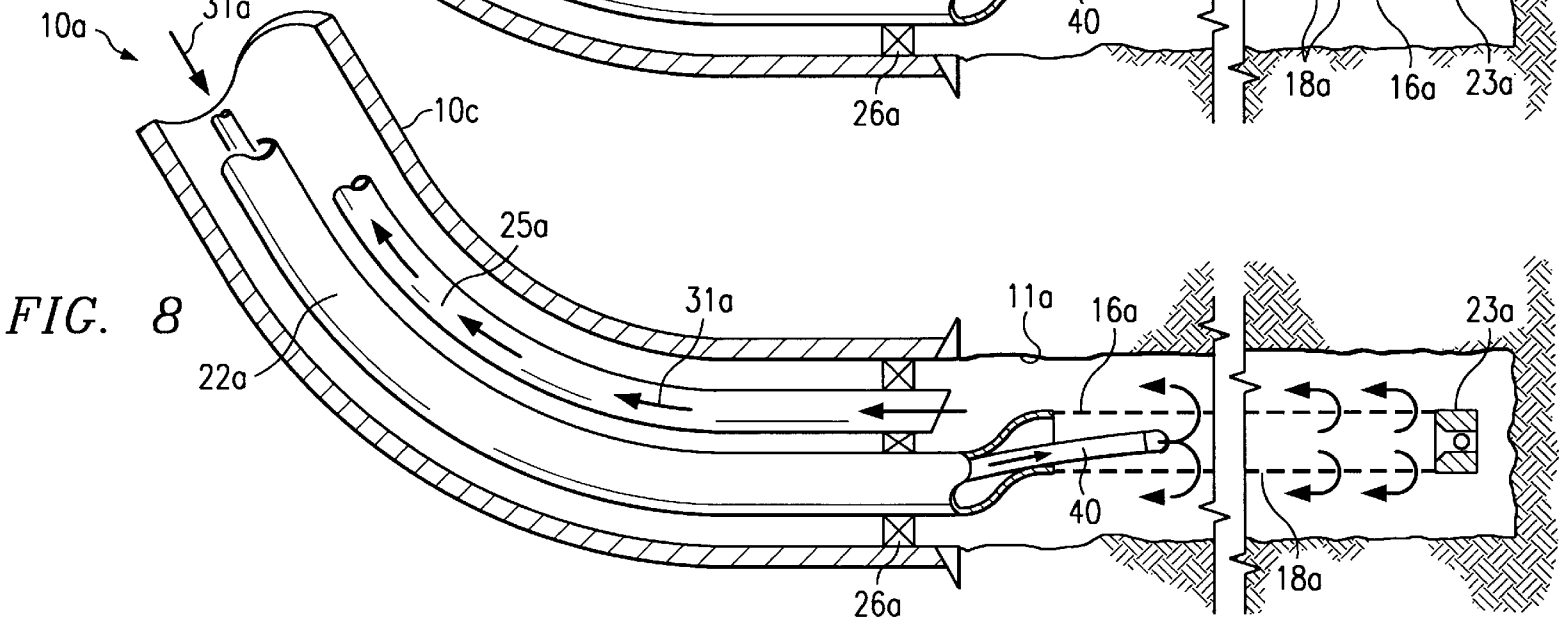
FIG. 8 is an elevational view, partly in section, of the downhole assembly of FIG. 7 during a further clean-up step of the present invention.

If liner 16*a* becomes plugged during production, a third string of tubing 40 (e.g. coiled tubing; FIG. 7) may be lowered through the production string of tubing 22*a* and stabbed-into seal nipple/float valve 23*a* at the lower end of liner 16*a*. A treating fluid (arrows 31*a*, FIG. 7) is pumped down third tubing string 40 and out through valve 23*a* into wellbore 11*a* to wash the plugging material from the outer surface of liner 16*a* back to the surface through now open second string 25*a*. After the liner 16*a* has been washed, third tubing string 40 can be released from seal nipple/float valve 23*a* and raised within liner 16 (FIG. 8).

Flow of treating fluid 31*a* is continued through tubing string 40 as it is being raised so that fluid will exit at different levels within liner 16*a* and directly impinge against the liner 16*a* at different points along its length thereby inhancing the cleaning action of the treatment fluid. The third tubing string 40 is then withdrawn; second tubing string 25*a* is closed; and the well is again put on production.

What is claimed is:

1. An assembly for treating a portion of a wellbore for removing solids therefrom; said assembly comprising:

a liner positioned within said portion of said wellbore to be treated, said liner having openings therein which allow flow of fluid therethrough while effectively blocking any substantial flow of solids therethrough;

a first string of tubing in said wellbore in said wellbore fluidly connected to said liner and extending to the surface;

a second string of tubing in said wellbore positioned substantially parallel to said first string of tubing and extending from said surface to a point substantially adjacent the top of said portion of said wellbore to be treated wherein an annulus is formed between said wellbore and said first and second strings of tubing;

packing means for blocking flow through said annulus; and a one-way valve at the lower end of said liner for allowing flow out of said liner while preventing flow into said liner.

2. The assembly of claim 1 wherein said first string of tubing includes:

a section which extends through said liner and is connected to said one-way valve, at least one valve spaced along said section, said at least one valve being movable between an open position for allowing flow between said first tubing string and said liner and a closed position for preventing between said first string said liner.

3. The assembly of claim 2 wherein said at least one valve comprises:

a plurarity of valves spaced along said section of said first tubing string which lies within said liner.

4. The assembly of claim 1 including:

a third string of tubing extending from the surface through said first string of tubing and having one end fluidly connected to said one-way valve in said liner.

5. The assembly of claim 4 wherein said third string of tubing is coiled tubing.

6. In a wellbore having a substantially horizontal portion, an assembly for removing solids from said substantially horizontal portion and for producing fluids therefrom, said assembly comprising:

a liner assembly comprising:

a liner section having openings therein which allow flow of fluid therethrough while effectively blocking any substantial flow of solids therethrough, said liner section being positioned within said substantially horizontal portion of said wellbore when in an operable position within said wellbore;

a one-way valve mounted in the lower end of said liner section; and a sub section connected to the top of said liner section wherein an annulus is formed between said wellbore and said sub section, said sub section having at least one port therein to allow flow into and out of said sub section;

a first string of tubing in said wellbore extending from the surface through said sub section and said liner section and fluidly connected to said one-way valve at the lower end of said liner section;

a second string of tubing in said wellbore positioned substantially parallel to said first string of tubing and extending from said surface to a point within said sub section wherein an annulus is formed between said sub section and both said first and second strings of tubing;

first packing means within said sub section for blocking flow through said annulus between said sub section and both said first and second strings of tubing;

second packing means between said sub section and said wellbore for blocking flow through said annulus between said wellbore and said sub section; and valve means for allowing flow between said first tubing string and said liner section when in an open position and for preventing flow between said first tubing string and said liner section when in a closed position.

7. The assembly of claim 6 wherein said valve means comprises:

a plurality of valves spaced along said first tubing string within said liner section.

8. The assembly of claim 7 wherein said valves are comprised of sliding-sleeve valves.

9. A method for treating a portion of a wellbore to remove solids and the like and to produce fluids therefrom, said method comprising:

positioning a permeable liner in said portion of said wellbore;

providing a first flowpath from inside said liner to the surface;

providing a second flowpath from outside said liner to the surface;

flowing a treating fluid down said first flowpath and out through said liner and into said portion of said wellbore to thereby entrain solids and the like within said fluid;

flowing said treating fluid and entrained solids from said portion of said wellbore to said surface through said second flowpath;

ceasing flow of said treating fluid through said first flowpath;

closing flow through said second flowpath; and producing fluids from said portion of said wellbore through said liner and to the surface through said first flowpath.

10. The method of claim 9 wherein said treating fluid is flowed into said portion of said wellbore through the lower end of said liner.

11. The method of claim 9 wherein said treating fluid is flowed into said portion of said wellbore through the openings in said liner.

12. The method of claim 9 wherein said portion of said wellbore is substantially horizontal.

13. The method of claim 9 wherein said first flowpath includes a section which extends through said liner and has valve means spaced along said section and wherein said treating fluid is flowed into said portion of said wellbore through said spaced valve means and through said openings in said liner.

* * * * *